US006135803A

United States Patent [19]

Kovacik et al.

[11] Patent Number: 6,135,803

[45] Date of Patent: Oct. 24, 2000

[54] ELECTRICAL PLUG LOCK

[75] Inventors: James D. Kovacik, Brecksville; Paul S. Blanch, Broadview Heights; Stanley E. Grzywna, Elyria, all of Ohio

[73] Assignee: Alert Safety Lite Products Co., Inc., Bedford Heights, Ohio

[21] Appl. No.: 09/325,616

[22] Filed: Jun. 3, 1999

[51] Int. Cl.[7] ..... H01R 13/62

[52] U.S. Cl. ..... 439/369

[58] Field of Search ..... 439/367, 369, 439/372

[56] References Cited

U.S. PATENT DOCUMENTS

| | | |
|---|---|---|
| D. 264,045 | 4/1982 | Elliot et al. . |
| 1,665,095 | 4/1928 | Henry . |
| 1,844,916 | 2/1932 | Dykes . |
| 1,899,360 | 2/1933 | Roudebush et al. . |
| 1,988,171 | 1/1935 | Frank et al. . |
| 1,989,823 | 2/1935 | Raabe . |
| 2,406,567 | 8/1946 | Schueneman . |
| 2,461,427 | 2/1949 | Kneebone . |
| 2,487,801 | 11/1949 | Healy, Jr. . |
| 2,753,536 | 7/1956 | Tjader . |
| 2,761,109 | 8/1956 | Hacker . |
| 2,841,635 | 7/1958 | Witzell et al. . |
| 2,903,669 | 9/1959 | Gilman et al. . |
| 2,913,719 | 11/1959 | Martin . |
| 2,976,374 | 3/1961 | Poulsen . |
| 3,005,176 | 10/1961 | Berg . |
| 3,014,194 | 12/1961 | Berglund . |
| 3,344,393 | 9/1967 | Hendee . |
| 3,383,639 | 5/1968 | Anderson et al. . |
| 3,428,936 | 2/1969 | Arnao, Jr. . |
| 3,484,736 | 12/1969 | Wyse . |
| 3,609,638 | 9/1971 | Darrey . |
| 3,613,046 | 10/1971 | Kirk . |
| 3,960,432 | 6/1976 | Wilbur . |
| 3,999,828 | 12/1976 | Howell . |
| 4,145,105 | 3/1979 | Dobson . |
| 4,183,603 | 1/1980 | Donarummo . |
| 4,204,738 | 5/1980 | Tillotson . |
| 4,221,449 | 9/1980 | Shugart, Jr. . |
| 4,424,407 | 1/1984 | Barbie . |
| 4,664,463 | 5/1987 | Carmo . |

*Primary Examiner*—Khiem Nguyen
*Attorney, Agent, or Firm*—MacMillan, Sobanski & Todd, LLC

[57] ABSTRACT

A plug lock for receiving an engaged plug and connector. The plug lock comprises a first side and a second side. Each of the first side and the second side have ribbed interior walls. A first end abutment connects the first side and one end of the second side. The first end abutment has a cord opening. The second end abutment is positioned opposite the first end abutment and connects the first side and the second side. The second end abutment has a clamp opening and a clamp portion extending through the clamp opening. The clamp portion has an outer surface with diametrically opposed ribbed portions configured to engage the ribbed interior walls of the first side and the second side and diametrically opposed smooth portions to slide over these ribbed interior walls. In use, a female plug terminates an electrical cord led through the clamp portion. A male plug terminates an electrical cord led through the cord opening and the male plug is engaged in the female plug. The clamp portion is positioned with the diametrically opposed smooth portions facing the ribbed interior walls and moved longitudinally against the engaged plug so that the connector holds the engaged plug against the first end abutment. The clamp portion is then rotated so that the diametrically opposed ribbed portions engage the ribbed interior walls to lock the clamp portion in position.

10 Claims, 3 Drawing Sheets

ELECTRICAL PLUG LOCK

BACKGROUND OF THE INVENTION

The present invention relates generally to a connector for maintaining the connection between electrical plugs and connectors and, in particular, to a plug lock for receiving an engaged plug and connector such as occurs when two electrical extension cords or a power cord from an appliance and an extension cord are joined together.

A portable electrical appliance such as a power saw, vacuum cleaner or the like is often used with an extension cord connected to the power cord of the appliance. It is not uncommon when using an electrical appliance connected to an extension cord that opposing forces along the axis of the cord cause the separation of the connection between the male and female plugs. This can be the result of one of the cords getting caught on an obstruction as the appliance is moved, the appliance being moved so that the cords are fully extended, or the appliance being used in an elevated location such that gravity pulls on the cord, for example.

Having the plugs separate completely is an annoying event; the user must stop whatever he is doing and restore the connection. Having the female and male plugs separate only partially is more than an annoyance. Electrically hot portions of the male plug can be exposed and cause electrical shocking or ignition of flammable material. In order to overcome these problems, a variety of plug clamps have been invented. For example, U.S. Pat. No. 3,609,638 describes a cord lock that is only adjustable if the connected cords are removed; U.S. Pat. No. 3,999,828 describes an adjustable device that uses friction for keeping the connected plugs together; and U.S. Pat. No. 4,664,463 uses a threaded adjustment device that keeps the connected plugs together.

The fact that the device described in U.S. Pat. No. 3,609,638 can only be adjusted when the connected cords are removed severely limits it usefulness. The device of U.S. Pat. No. 3,999,828 permits adjustment, but as the '828 device ages and the cords become coated with dirt and oil, for example, the '828 device's reliance on friction for keeping the connected plugs together is insufficient. The threaded adjustment device of U.S. Pat. No. 4,664,463 partially overcomes the deficiencies of the '638 and '828 devices. But the '463 device can only be manipulated slowly under ideal conditions (indoors or during warm weather) and could easily prove to be impossible to manipulate under adverse conditions (at cold temperatures for example).

Thus, it would be desirable to have a cord lock device that can be rapidly and easily adjusted yet will securely lock connected male and female plug ends in position.

SUMMARY OF THE INVENTION

The present invention concerns a plug lock for receiving an engaged plug and connector. The plug lock comprises a first side and a second side. Each of the first side and the second side have ribbed interior walls. A first end abutment connects one end of the first side and one end of the second side and has a cord opening. A second end abutment is positioned opposite the first end abutment and connects the opposite ends of the first side and the second side. The second end abutment has a clamp opening and a clamp portion extending through the clamp opening. The clamp portion has an outer surface with diametrically opposed ribbed portions configured to engage the ribbed interior walls of the first side and the second side and diametrically opposed smooth portions to slide over these ribbed interior walls.

In use, a female (or male) plug terminates an electrical cord led through the clamp portion. A male (or female) plug terminates an electrical cord led through the cord opening and the male plug is engaged in the female plug. The clamp portion is positioned with the diametrically opposed smooth portions facing the ribbed interior walls and moved longitudinally against the engaged plug so that the connector holds the engaged plug against the first end abutment. The clamp portion is then rotated so that the diametrically opposed ribbed portions engage the ribbed interior walls to lock the clamp portion in position.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
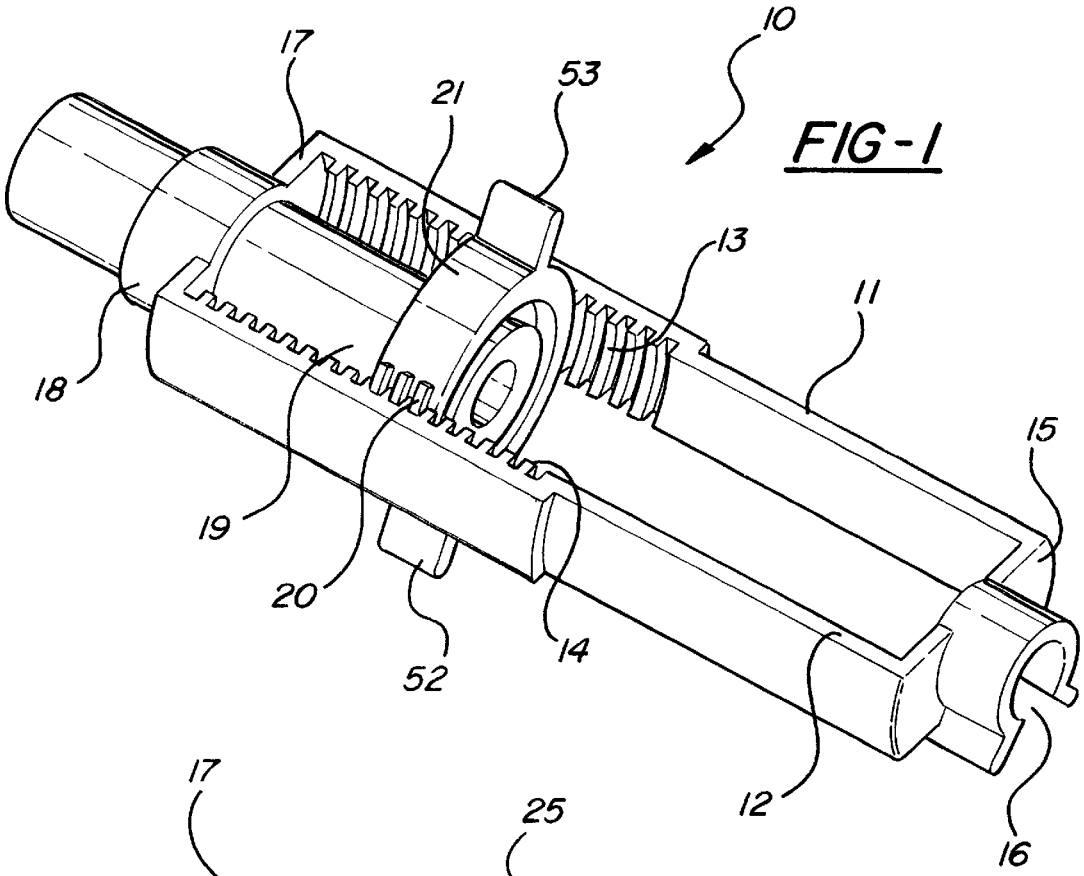
FIG. 1 is a perspective view of a plug lock according to the invention illustrating ribs of the clamp portion engaged with the ribbed interior walls of the first and second sides.
Figure 2:
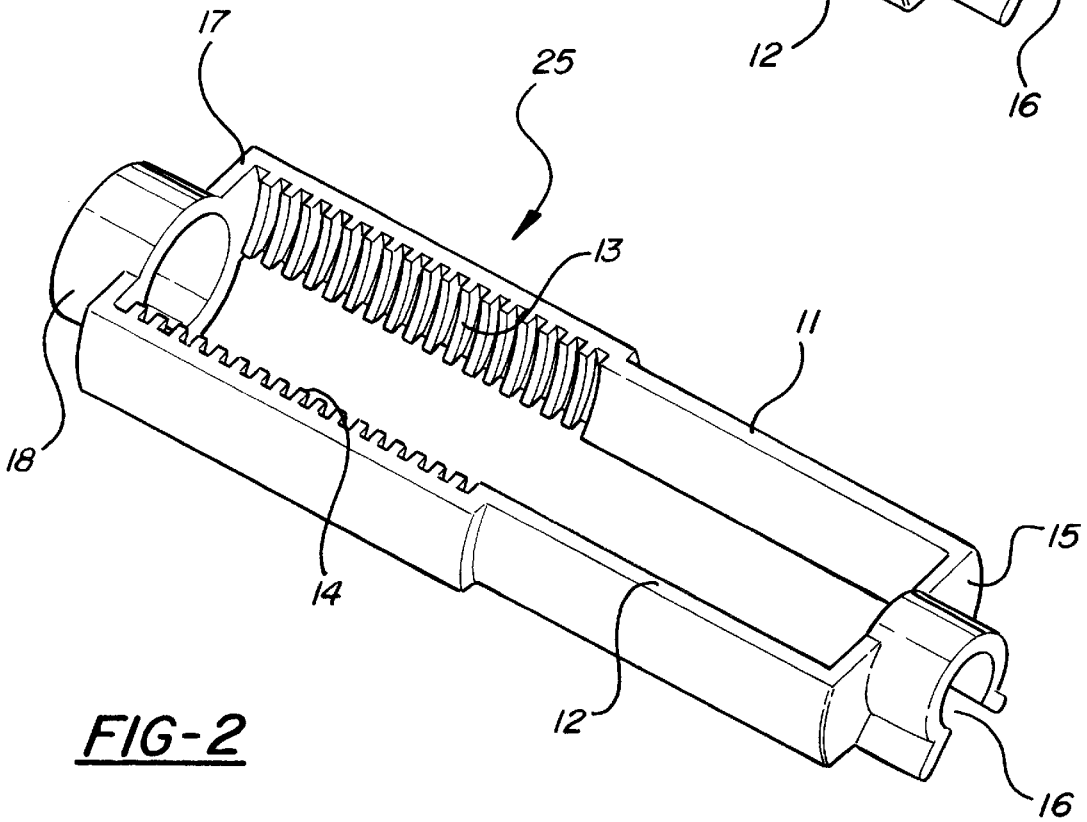
FIG. 2 is a perspective view of the first and second side walls and the fist and second end abutments as shown in FIG. 1.

There is shown in the FIG. 1 a plug lock 10 according to the present invention. The plug lock 10, includes a first side 11 and a second side 12 joined together at one end by a first end abutment 15 and at the other end by a second end abutment 17. Together, the first side 11, the second side 12, the first end abutment 15, and the second end abutment 17 form a frame 25 for the cord lock of the invention as illustrated separately in FIG. 2.

Figure 4:
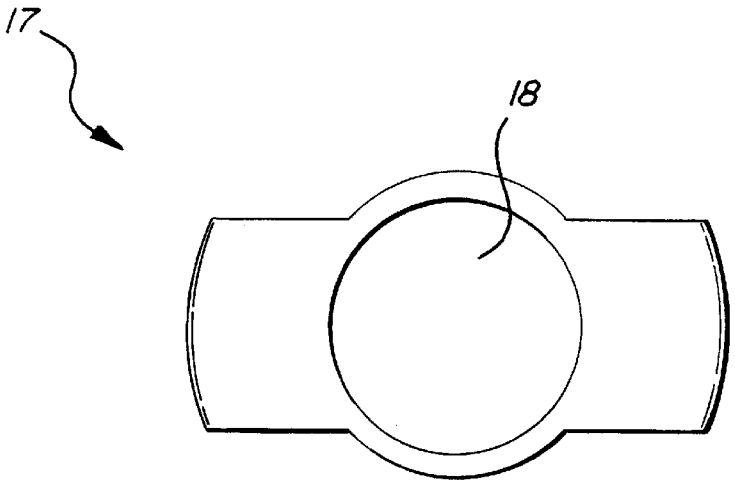
FIG. 4 is a plan view of the second end abutment illustrating the clamp opening.
Figure 3:
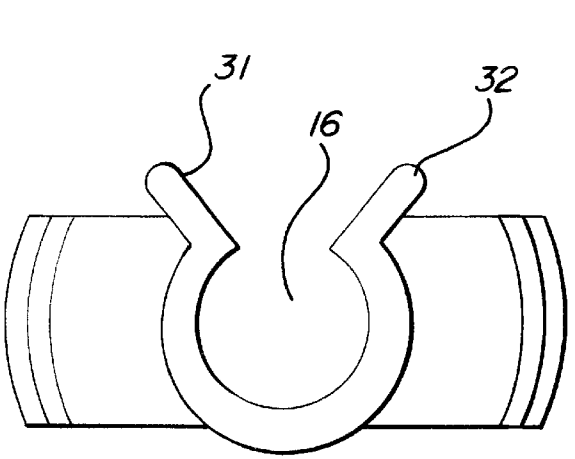
FIG. 3 is an plan view of the first end abutment illustrating the cord opening.

More specifically, the first side 15 and the second side 17 are each configured with ribbed interior walls 13, 14, respectively. The first end abutment 15 is configured with a cord opening 16. As illustrated in FIG. 3, the cord opening 16 is formed with flared ends 31 and 32 to simplify pushing an electrical cord into the cord opening 16. The second end abutment 17, as illustrated in FIG. 4, has a clamp opening 18.

Figure 5:
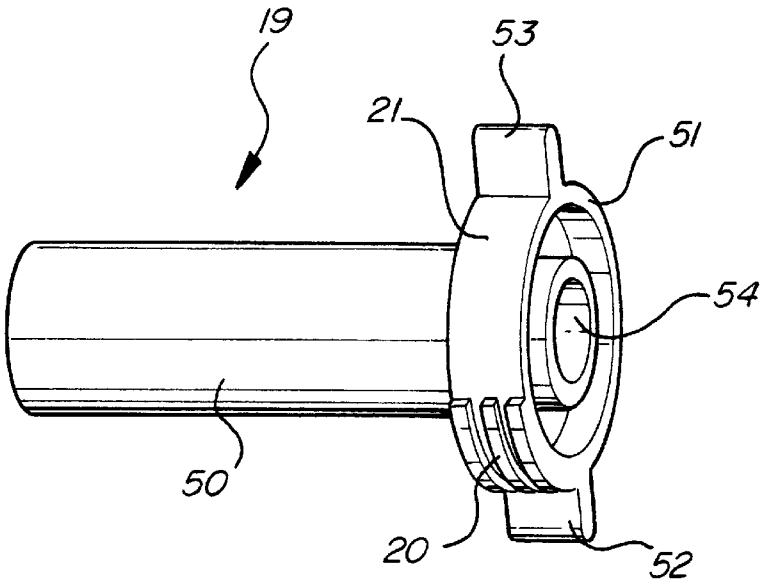
FIG. 5 is perspective view of the clamp portion shown in FIG. 1 illustrating a barrel that extends through the clamp opening of the plug lock and an adjustment disk attached to the barrel where the adjustment disk has ribbed and smooth portions.
Figure 6:
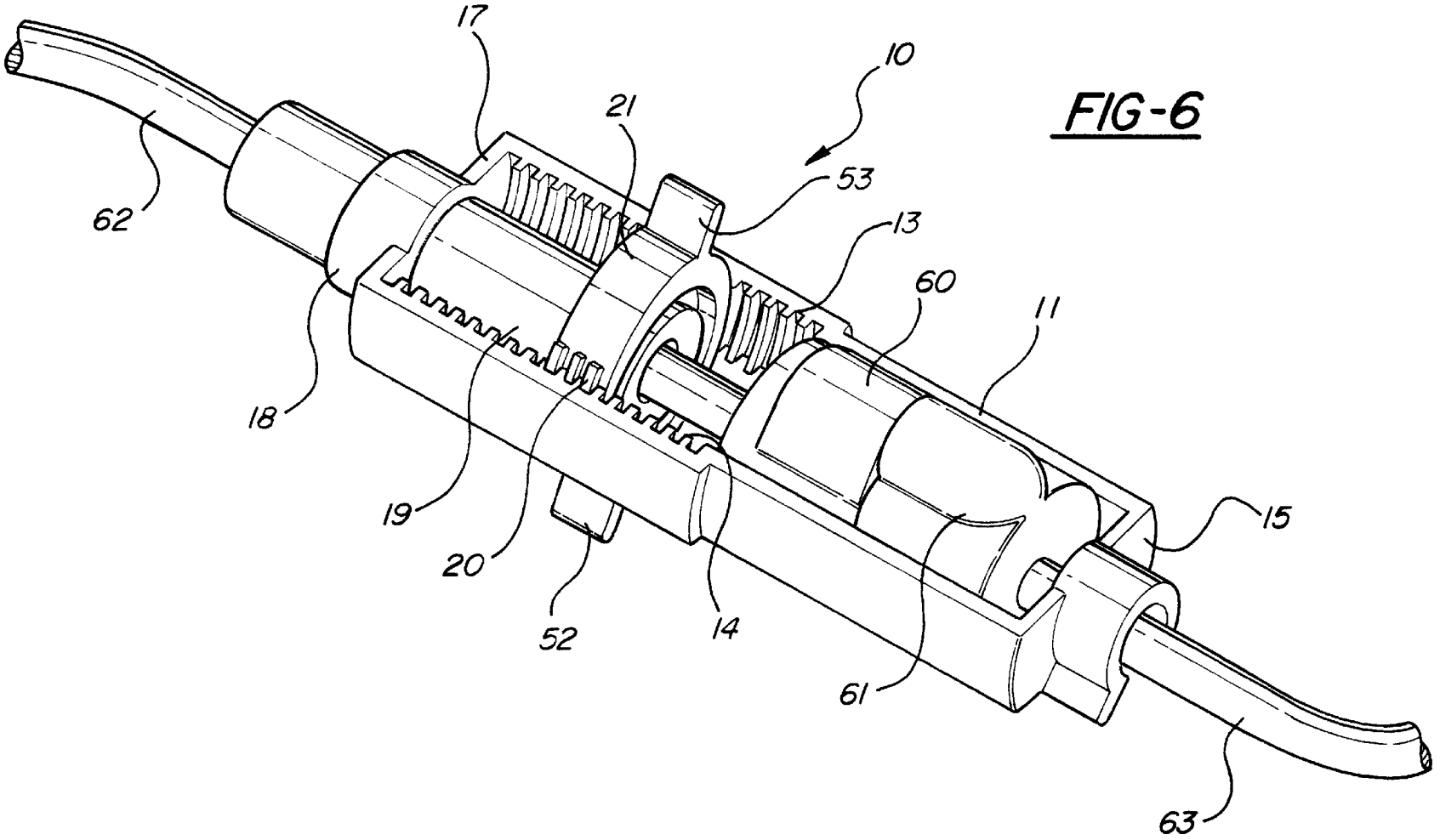
FIG. 6 is a perspective view of connected electrical cords positioned between the sidewalls of the cord lock of FIG. 1.

The clamp opening 18 is sized to accept the barrel 50 of the clamp portion 19. As shown in FIG. 5, the clamp portion 19 consists of the barrel 50 connected to an adjustment ring 51. The outer surface of the adjustment ring 51 has diametrically opposed ribbed portions 20 that alternate with diametrically opposed smooth portions 21 (only one each of the ribbed and smooth portions are visible in FIGS. 1 and 5). The ribbed portions 20 are configured to interlock with the ribbed interior walls 13, 14. Diametrically opposed adjustment wings 52 and 53 can also be provided between the ribbed portions 20 and the smooth portions 21. A bore 54 is provided through the axis of the adjustment ring 51 and the barrel 50 for the electrical cord to pass through.

The clamp portion 19 is configured so that the barrel 50 fits into the clamp opening 18. The adjustment ring 51 is sized so that the smooth portions 21 generally fit between the interior walls of the first side 15 and the second side 17. When the adjustment ring 51 is rotated, the ribbed portions 20 engage the ribbed interior walls 13, 14 of the first side 11 and second side 12 or disengage so that the smooth portions 21 slide over the ribbed interior walls 13,14.

The illustrated embodiment is designed to be mounted on an extension cord prior to mounting either the male end, the female end, or an electrical appliance. Thus, to assemble the illustrated embodiment, the barrel 50 of the clamp portion 19 is slipped into the clamp opening 18, and the adjustment ring 51 rotated so that the smooth portions 21 are opposite the ribbed interior walls 13, 14. The adjustment ring 51 is then moved flush against the second end abutment 17. A cord end (which may have a female end, male end, or appliance installed on the opposite end) is passed into the bore 54, through the adjustment ring 51 and the barrel 50. (Alternately, the cord could be passed in the bore 54 first through the barrel 50 and then the adjustment ring 51, and an appropriate female or male end added.) The desired female end, male end, or electrical appliance is installed on the end of the cord.

When utilizing an appliance or extension cord 62 equipped with a cord lock 10 of the present invention, a user pulls sufficient slack through the clamp portion 19 to free an attached end 60 from the cord lock 10. The user then plugs a corresponding end 61 from another electrical cord 63 into the attached end 60, positions the connected plugs 60, 61 between the first side 11 and the second side 12, and pushes the power cord 63 of the other electrical cord into the cord opening 16. After rotating the adjustment ring 51 (aided by the wings 52, 53 if necessary) so that the smooth portions 21 are adjacent the ribbed interior wall 13, 14, the user slides the clamp portion 19 until the connected ends 60, 61 are held pinched together between the first end abutment 15 and the adjustment ring 51 of the clamp portion 19. The adjustment ring 51 is then rotated so that the ribbed portions 20 engage the ribbed interior walls 13, 14 to lock the clamp portion 19 in position and keep the connected ends 60, 61 pinched between the adjustment ring 51 and the first end abutment 15.

The present invention is described above in a configuration that lends itself to OEM applications. Alternatively, the present invention may be configured to be attached by the consumer to appliances and power cords that he already has in his possession thereby permitting a plug lock according to the invention to be added to any extension cord or appliance after final assembly. In such an embodiment, the adjustment ring 51, the barrel 50, and the clamp opening 18 of the second end abutment 17 are configured so that they may be opened and closed around a cord on which the plug ends or plug end and appliance are already installed. One method by which this may be accomplished is to slit the clamp portion 19 and the clamp opening 18. Such a slit permits the consumer to open the clamp portion 19 and place it around the cord 62 of a portable electrical appliance, for example. The slit in the clamp opening 18 would be sized to permit only the electrical cord 62 to slip through (in a manner analogous to the cord opening 16 in the first end abutment 15 as discussed above). Thus, after positioning the clamp portion around the electrical cord, the consumer would slide an adjacent portion of the electrical cord 62 through the slit in the clamp opening 18 and then position the barrel 50 through the clamp opening as illustrated in FIG. 1. The clamp opening would tend to keep the slit in the clamp open portion 19 closed.

A cord lock according to the invention is preferably formed from plastic. Suitable plastics are polyethylene or polypropylene. The cord lock may be fabricated using any suitable process such as injection molding, vacuum molding, or blow molding.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A plug lock for receiving an engaged plug and connector, said plug lock comprising:

a first side and a second side, each of said first side and said second side having ribbed interior walls;

a first end abutment connecting said first side and one end of said second side, said first end abutment having a cord opening;

a second end abutment positioned opposite said first end abutment connecting said first side and said second side, said second end abutment having a clamp opening; and a clamp portion extending through said clamp opening, said clamp portion having an outer surface with diametrically opposed ribbed portions configured to engage said ribbed interior walls of said first side and said second side and diametrically opposed smooth portions to slide over said ribbed interior walls of said first side and said second side.

2. The plug lock of claim 1 where said clamp portion is positioned with said diametrically opposed smooth portions facing said ribbed interior walls and moved longitudinally against said engaged plug and connector to hold them against said first end abutment; and then rotated so that said diametrically opposed ribbed portions engage said ribbed interior walls and lock said clamp portion in position.

3. The plug lock of claim 1 where said clamp portion comprises:

a barrel sized to fit in said clamp opening; and an adjustment ring connected to said barrel, said adjustment ring having an outer surface with diametrically opposed ribbed portions configured to engage said ribbed interior walls of said first side and said second side and diametrically opposed smooth portions to slide over said ribbed interior walls of said first side and said second side.

4. The plug lock of claim 3 where said adjustment ring has wings on its outer surface.

5. The plug lock of claim 1 where said second end abutment and said clamp portion are configured to permit said plug lock to be added to any extension cord or appliance after final assembly.

6. The plug lock of claim 1 manufactured from plastic.

7. The plug lock of claim 6 where said plastic is chosen from the group consisting of polyethylene and polypropylene.

8. The plug lock of claim 1 manufactured using injection molding.

9. The plug lock of claim 1 manufactured using vacuum molding.

10. The plug lock of claim 1 manufactured using blow molding.

* * * * *